US008157004B2

(12) United States Patent
Matherne, Jr. et al.

(10) Patent No.: US 8,157,004 B2
(45) Date of Patent: Apr. 17, 2012

(54) PIPE HANDLING APPARATUS

(76) Inventors: Lee J. Matherne, Jr., Lafayette, LA (US); Kris Henderson, Lafayette, LA (US); Joseph L. Hawkins, Maurice, LA (US); Lee M. Robichaux, Lafayette, LA (US)

( * ) Notice: Subject to any disclaimer, the term of this patent is extended or adjusted under 35 U.S.C. 154(b) by 0 days.

(21) Appl. No.: 12/798,983

(22) Filed: Apr. 15, 2010

(65) Prior Publication Data

US 2010/0218935 A1 Sep. 2, 2010

Related U.S. Application Data

(63) Continuation-in-part of application No. 12/319,005, filed on Dec. 31, 2008, now abandoned.

(51) Int. Cl.
*E21B 19/16* (2006.01)
*E21B 23/00* (2006.01)

(52) U.S. Cl. ..... 166/77.51; 166/77.53; 166/85.1; 166/381; 175/423

(58) Field of Classification Search ..... 166/77.51, 166/77.53, 85.1, 381; 175/423
See application file for complete search history.

(56) References Cited

U.S. PATENT DOCUMENTS

2010/0163248 A1* 7/2010 Robichaux et al. ..... 166/381
* cited by examiner

*Primary Examiner* — Giovanna Wright
(74) *Attorney, Agent, or Firm* — Ted M. Anthony

(57) ABSTRACT

An arbor arranged for attachment to overhead support, such as a top drive or main rig hoist, is arranged to resiliently support a main body. The main body is arranged to support a wedge-lock type pipe gripper assembly on a second arbor that is resiliently supported by the main body. The two arbors are rotationally connected but only indirectly connected axially and, to a limited extent, can move independently. The actuator, or linear motor, that actuates the wedge-lock system has the ability to force release of the wedge-lock system when it has been set by massive pipe loads. The forced release actuation is independent of the load supporting features of the main body. Full range actuation of the main body linear motor will not actuate the wedge-lock release system.

11 Claims, 9 Drawing Sheets

PIPE HANDLING APPARATUS

This application is a continuation-in-part of application Ser. No. 12/319,005 filed on Dec. 31, 2008 now abandoned.

This invention pertains to apparatus primarily for gripping pipe for manipulating pipe sections and pipe strings being installed in or removed from wells.

BACKGROUND OF THE INVENTION

During drilling and casing of wells, a pipe string is assembled by adding stands of pipe, consisting of one or a plurality of pipe sections, to pipe strings. The pipe strings extend through the drilling floor rotary opening and continue downward into existing well bores. The pipe string being assembled may be drill strings or casing strings, and occasionally other tubular strings.

The rate of the pipe string assembly is part of the well drilling time involvement and can amount to many hours of total well producing time involved. Cost reduction, involves time reduction in pipe string assembly.

Well production time, in terms of drilling rate, has been addressed with great earnest for many years. Pipe string assembly rate has about the same cost effectiveness as drilling rate. This invention addresses the reduction of costs, and does so within the safety concerns common to well bore production and production expected of completed wells.

For safety reasons, the use of personnel in contact with tubulars during pipe string assembly on the drilling floor is being minimized. Full mechanization of such activities on the drilling floor is not always possible but every effort to limit the contact between the more dangerous activities and people is worthwhile.

Offshore drilling rigs are usually massively complex and costly and the addition of machinery approaching automatic functions is not an expense that is a large percentage of the overall costs. On smaller on-shore rigs, the complex machinery is not readily adaptable and the reduction of contact between men and machinery is approached with simpler apparatus such as the present invention.

Pipe being assembled by adding threaded sections is rotated at the upper end during the thread run. At times, during the lowering of the pipe string into the well, the pipe string is rotated to facilitate installation in the well and that is done from the top of the string.

In economic interest, the feed rate during the lowering of the string into the well is maximized, within the limits of safety considerations. The downwardly moving string occasionally encounters cause for brief stoppage, usually called ledging. The massive hoisting machinery that supports the moving pipe string is hard to stop and the result is usually a jarring experience in many respects. There is a need for some form of shock minimizing apparatus between the pipe string and the hoisting machinery. The cushioning effect is often called float and one feature of the present invention is to provide that enhancement.

Machines carrying heavy and dangerous loads normally have a design safety margin that seems adequate unless shock is encountered. Shock that is inherent to function, such as ordnance, has been defined through tests but such tests are not possible in oil field hoisting situations. Any potentially dangerous shock load needs a cushioning factor if it is not well defined and considered during design.

The expression "wedge lock gripper" usually refers to the inclusion of a self-locking taper that will not "un-do" if the actuating load is removed. To make the wedge lock feature "fail safe" the supported load needs to urge the wedge part engaging the load in the grip actuating direction. Increasing load then increases the grip. The gripping dies and the activating wedge is often called a grapple.

Once a maximum load is realized, and the fail safe feature has increased the grip on the load, the force needed to disengage the wedge lock could well exceed the force used to actuate the fail safe system. Reserve force may be needed to unlock the pipe gripper when appropriate. The wedge-lock feature of fail-safe apparatus is seldom, if ever, released during the time that the pipe string is supported by the main hoist apparatus. A forceful release feature related to the wedge-lock assembly is suitable if it can release only one stand of pipe. The forceful release, however, needs to release the wedge-lock assembly that has been set by the massive load of a pipe string. The feature providing the float quality to the pipe string, if not arranged to force the release, needs to be augmented by structure that can provide the force needed to release a heavily engaged wedge-lock assembly. The present invention is, in part, directed toward the certainty of wedge-lock release ability.

If a pipe string can be deliberately released by the supporting means, sooner or later it will be done accidently. It is prudent to provide an arrangement that will hold a pipe string in suspension regardless of any effort made to release it. The apparatus of this invention addresses that need.

SUMMARY OF THE INVENTION

An arbor arranged for attachment to overhead support, such as a top drive or main rig hoist, is arranged to resiliently support a main body. The main body is arranged to support a pipe grapple assembly on a second arbor that is resiliently supported by the main body. The two arbors are rotationally connected but only indirectly connected axially and, to a limited extent, can move independently. The forced release actuation is independent of the load supporting features of the main body. Full range actuation of the main body linear motors will not actuate the wedge-lock release system if more that a preselected load is being suspended.

These and other objects, advantages, and features of this invention will be apparent to those skilled in the art from a consideration of this specification, including the attached claims and appended drawings.

BRIEF DESCRIPTION OF DRAWINGS

The exemplary drawings illustrate the preferred configuration of the apparatus. They are not intended to represent the only configuration usable in practicing the claimed points of novelty.

FIG. 2 continues from the lower end of FIG. 1. There is some overlap.

FIG. 1 shows the upper end of the apparatus, mostly in cut-away.

FIG. 2 shows the lower end of the apparatus, mostly in cut-away.

DETAILED DESCRIPTION OF DRAWINGS

In the formal drawings, details that do not bear upon points of novelty, are not of value in understanding descriptive matter, and are within the capability of those skilled in the art, are omitted in the interest of descriptive clarity. Such omitted details may include weld lines, pins and threaded fasteners, seal details and the like.

Linear motors use power to produce linear movement. There are many forms of such motors. Most prevalent are fluid powered cylinders. They are simple to design, use, and explain. They are used in the current descriptive matter, but they should not be construed in a limiting sense.

Figure 1:
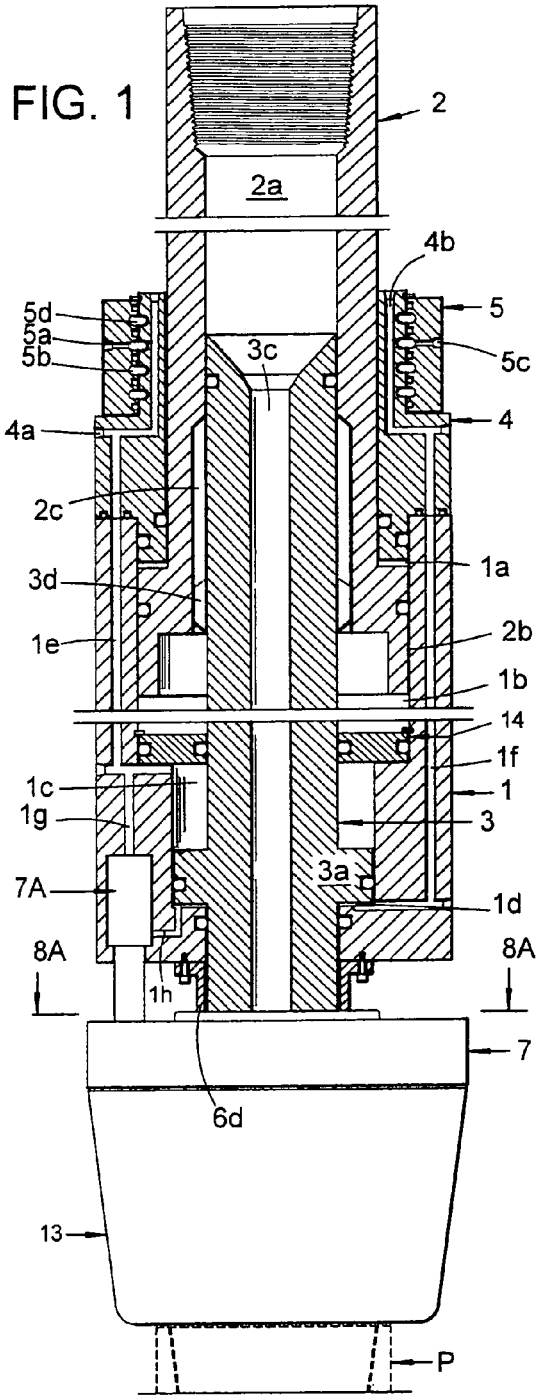
FIGS. 1 and 2 are mutually continuous.
Figure 2:
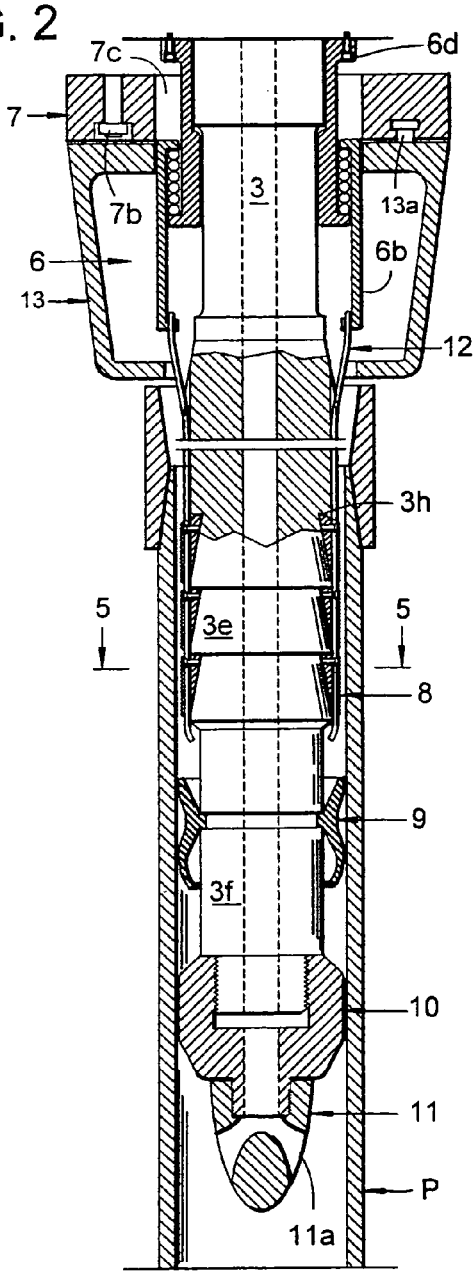
Figure 3:
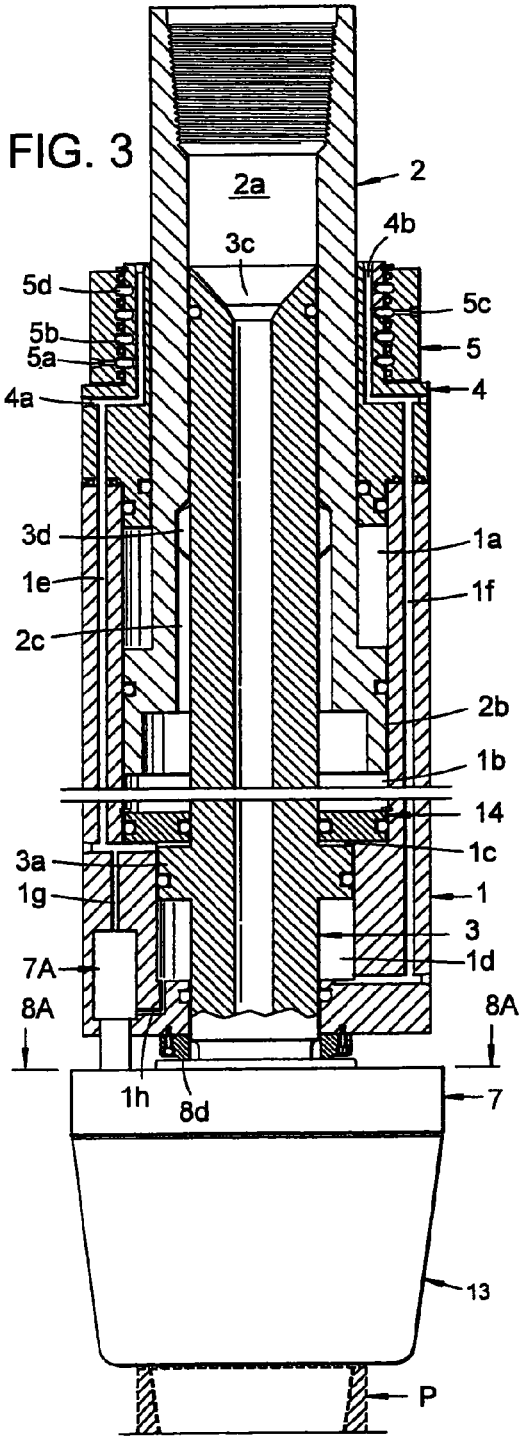
FIG. 3 shows the structure of FIG. 1 after actuation of the wedge-lock feature.

FIGS. 1 and 2 are mutually continuous, FIG. 2 being the bottom portion. FIGS. 1 and 3 are shown before and after actuation (respectively) to grip pipe. FIG. 1 consists mainly of three parts, main arbor 2, main body 1, and active arbor 3. The active arbor is spline connected to the main arbor by mating splines 2*c* and 3*d*.

Secondary parts include a cylinder cap 4, swivel 5 and baffle plate 7. Mud flows vertically along a sealed bore, or channel, 3*c* from the top, bore 2*a*, to the bottom of the apparatus.

Swivel 5 is bearingly supported on cap 4 and carries the working fluid flow into and out of the apparatus. The swivel does not rotate and is connected to rig related fluid lines (not shown) The cylinder cap may be retained on the main body by a ring of cap screws.

Baffle 7 is mounted on body 1 with cap screws 7*b* and is biased away from the body by fluid powered cylinder 7A. The continuing wedge-lock related parts project downward through hole 7*c*. The body-to-baffle gap is a position indicator for pipe being engaged.

The swivel 5 conducts fluid from ports such as 5*a* and 5*c* to peripheral galleries such as 5*b* and 5*d* which vent to ducts such as 4*a*, 4*b*,1*e*, and 1*f* to chambers such as 1*c*. Movement of piston 3*a* opens and closes the wedge-lock system. Pressure in chamber 1*d* closes the grip lock system onto pipe and pressure in chamber 1*c*, if adequate, forces the grip lock system to release a pipe if weighing less than the maximum force delivered by spring 6*a* (see FIG. 9).

Shroud 13 extends baffle 7 and protects the gripper biasing assembly 6.

Chamber 1*b* could vent to atmosphere but venting may be captured through an available gallery and vent circuit, at least partly to maintain particulate control.

Plate 14 is a bulkhead to separate chambers 1*b* and 1*c*.

The stroke of piston 2*b*, which functions as a hydraulic cylinder, can be any length that available operation space admits. The usual stroke may be in the order of one foot.

Working fluid used to power piston 2*b* may be compressible, non-compressible or the variant of both, usually called air over oil. In the air over oil version, the oil may provide power and the air (or gas) may provide cushion. The oil may be used for velocity control of linear motor parts. Alternatively the air may provide power and the oil provide regulation.

Pressure delivered to chamber 1*a* lifts body 1 and all supported weight.

FIG. 2 shows the portion of the apparatus that is inserted into a pipe to be handled. Nose piece 11 helps guide the apparatus into pipe. Ports 11*a* pass fluid moving down channel 3*c*. Drift 10 is just under the inside diameter of pipe to be handled and protects packing 9 from pipe edges and consequent damage.

Packing 9 is mounted in a ring on arbor extension 3*f*. The leak inducing differential pressure actuates the packing toward closure with the pipe bore. An alternate packing form is inflated by pressure in duct 3*c* and resembles a fat car tire. It is not shown.

The grippers, or dies, 8*a* show a three phase wedge arrangement, to be activated by three wedges 3*e* on the active arbor. Low quality pipe may justify distribution of the grippers along a plurality of wedges. In a uniform bore, in heavy wall pipe, one wedge phase may be adequate.

The grippers are retained on the active arbor by spring loaded axially extending straps 12 that reside in grooves in the active arbor and in grippers 8*a*. The grippers, or slips, or dies, 8*a* are urged toward the small end of the wedges 3*e* by spring 6*a* acting between elements 6*b* and 6*d*.

FIG. 3 is identical to FIG. 1 but has been actuated to grip pipe and to lift a pipe string load.

Piston 3*a* has closed the grippers onto pipe and pressure above piston 2*b*, in chamber 1*a*, acting on cylinder cap 4 has lifted the main body 1 and all supported load. Piston 2*b* may go to the top travel limit under pipe string loads.

Figure 4:
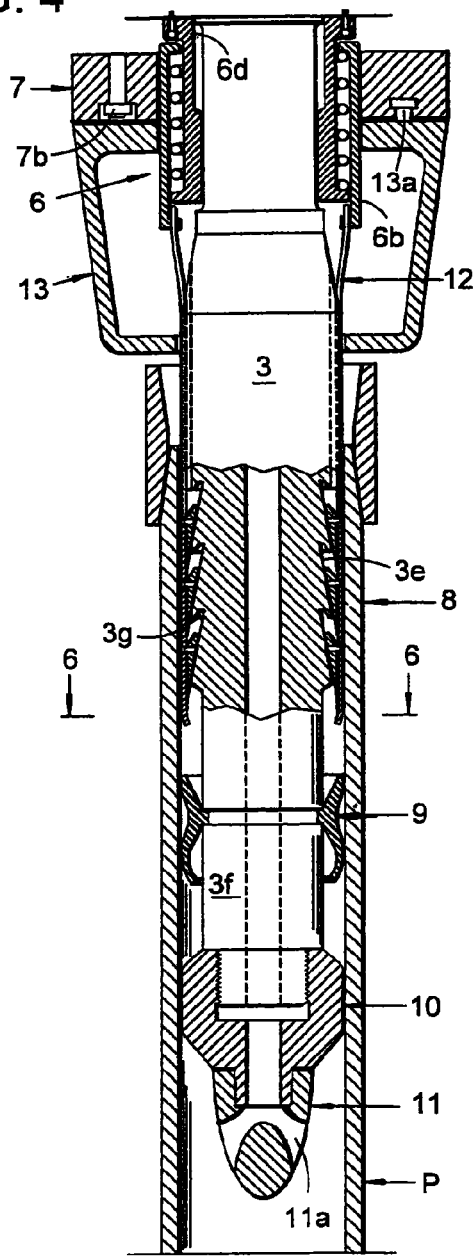
FIG. 4 shows the structure of FIG. 2 after the wedge-lock feature is actuated to grip pipe.

FIG. 4 is identical to FIG. 2 but the arbor 3 has been moved upward by piston 3*a*, which functions as a hydraulic cylinder, moving arbor wedges 3*e* upward, shortening the extending portion of arbor 3. The grippers upward movement is stopped by the engagement of flange 6*c* of element 6*b*, see FIG. 10.

After the grippers contact the pipe, the wedges 3*e* slide on the gripper surfaces easier than the grippers slide on pipe. The grippers do not greatly compress links 12 after the grippers make contact with the pipe.

Figure 5:
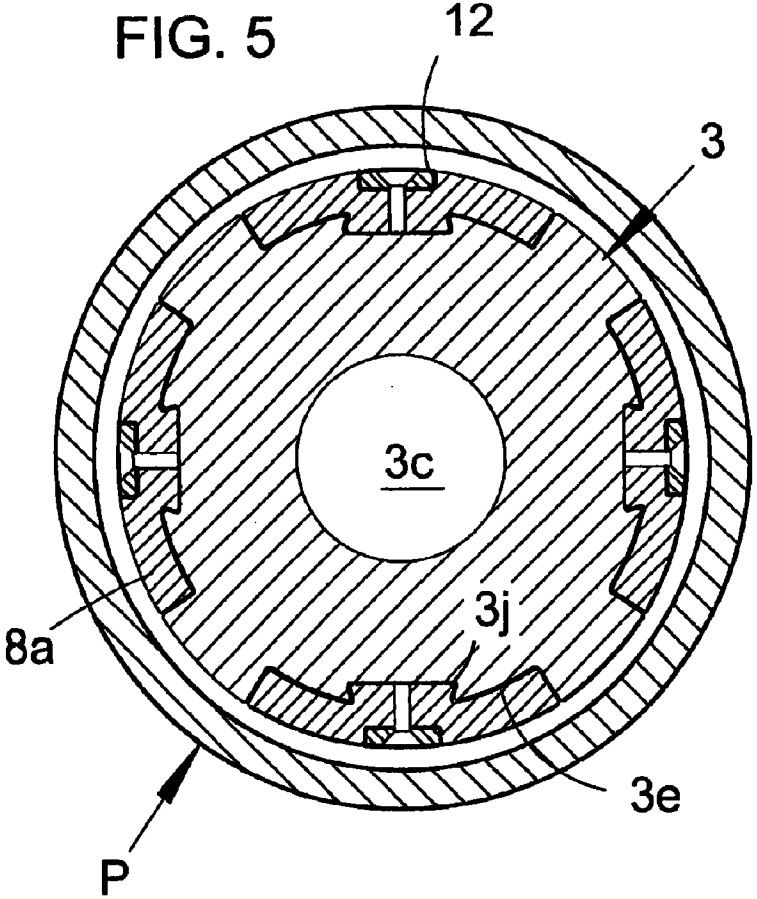
FIG. 5 is a section taken along line 5-5 of FIG. 2.

FIG. 5 shows pipe grippers 8*a* and arbor 3 joined by dovetail fittings 3*j*. On small pipe handling gear, arbor 3 can be highly stressed. And, to avoid stress raising configuration, the strap 12 may be, instead, confined to the surface of arbor 3, by bands, or the like, retaining the grippers. The dovetails, then are not needed.

Figure 6:
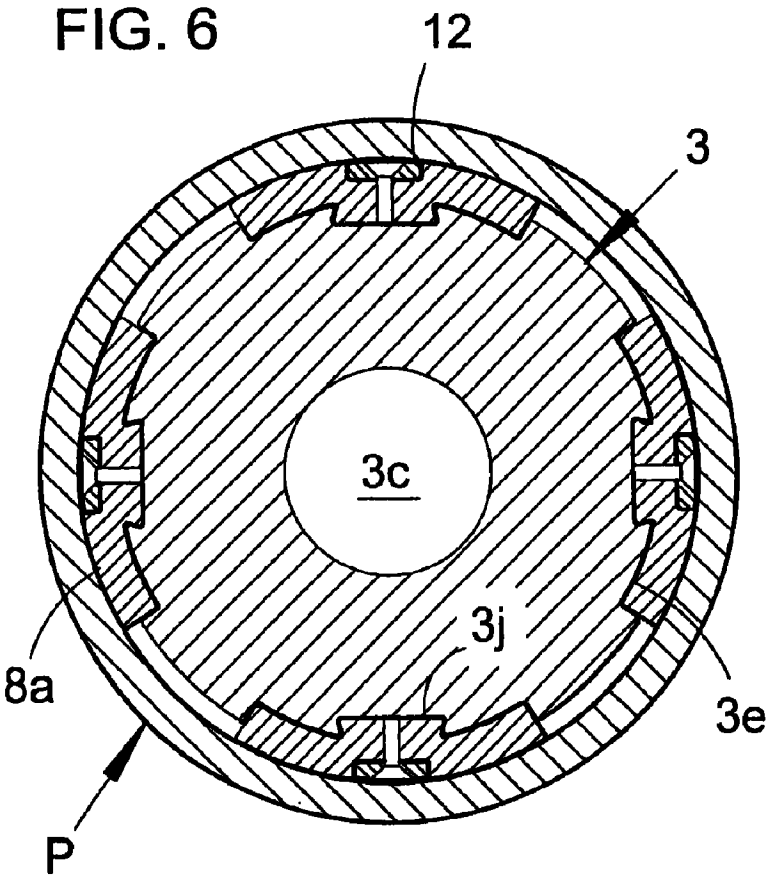
FIG. 6 is a section taken along line 6-6 of FIG. 4.

FIG. 6 is identical to FIG. 5 but has been actuated to set grippers against pipe.

Figure 8A:
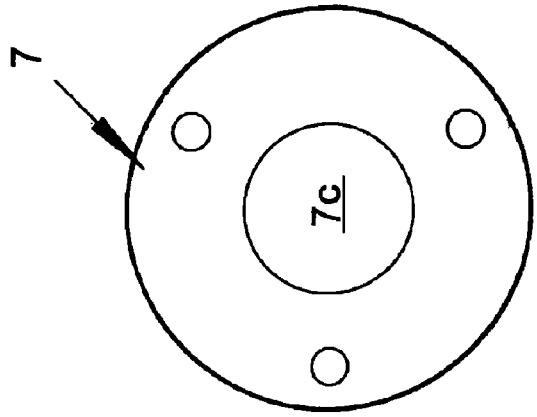
FIG. 8 is a section taken at the location of FIG. 6 but of an alternate configuration.
Figure 8:
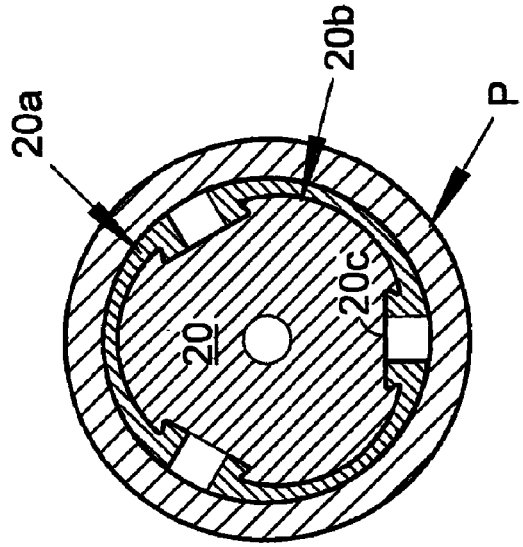
Figure 7:
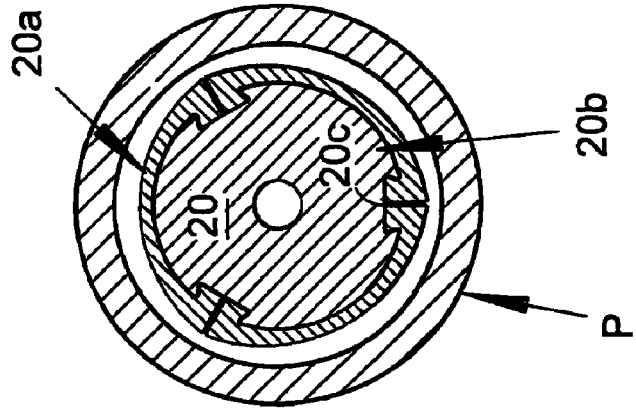
FIG. 7 is a section taken at the location of FIG. 5 but of an alternate configuration.

FIGS. 7 and 8 represent an alternate form of the section 5 and 6, shown by FIGS. 5 and 6. Active arbor 20 has 3 dovetail grooves 20*c*. Grippers 20*a* can have a near total peripheral coverage. Ramp 20*b* has to be of uniform shape and is slanted toward the arbor axis in the upward direction. To achieve rotation of pipe, the grippers are dragged peripherally and no gripper tilting in a dovetail slot occurs.

Figure 9:
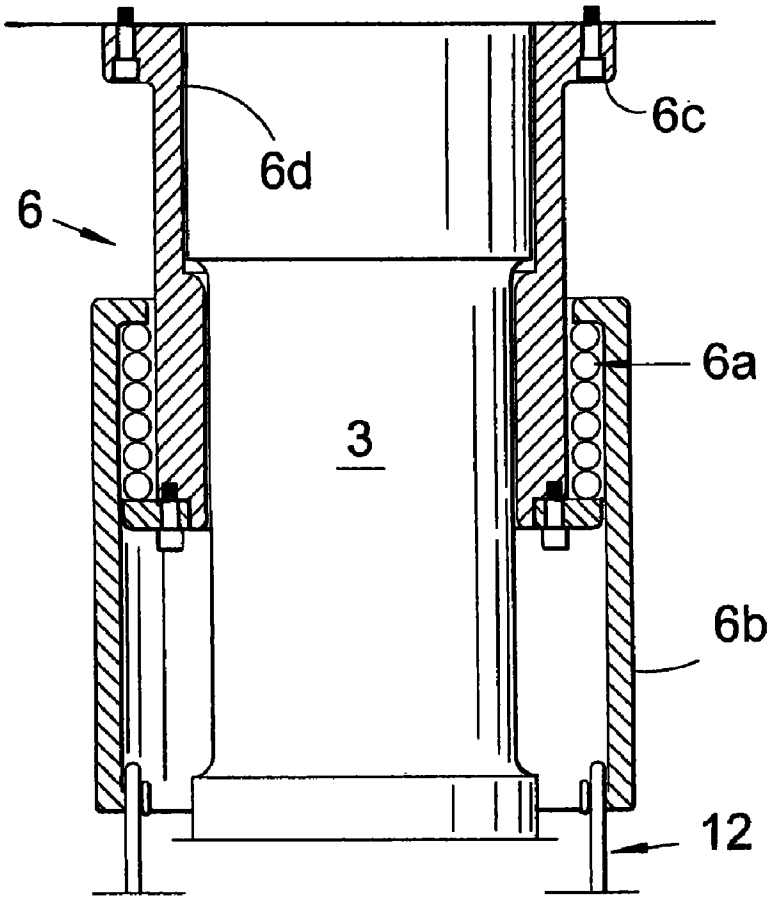
FIG. 9 is a side view, rather enlarged, of a fragment of the apparatus of the invention.

FIG. 9 is a side view of a biasing assembly that urges the slips to move to the release position. Drag link 12 connects element 6*b* to slips 8*a*. Support element 6*d* is bolted to the lower end of the housing 1. Spring 6*a* urges element 6*b* upward. Active arbor 3 has moved downward to collapse the slips. The overall design is such that spring 6*a* never makes up solid. There is always space between the loops.

Figure 10:
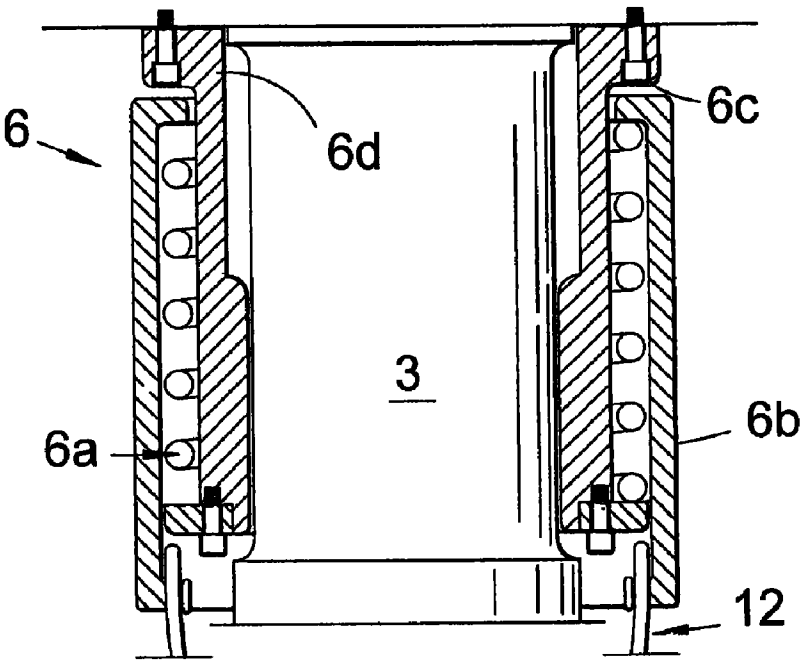
FIG. 10 is the same as FIG. 9, with parts in an alternate position.

FIG. 10 is the same as FIG. 9 with spring 6*a* extended. Arbor 3 has moved upward and the slips 8*a*, and drag link 12, have moved upward.

Figure 11:
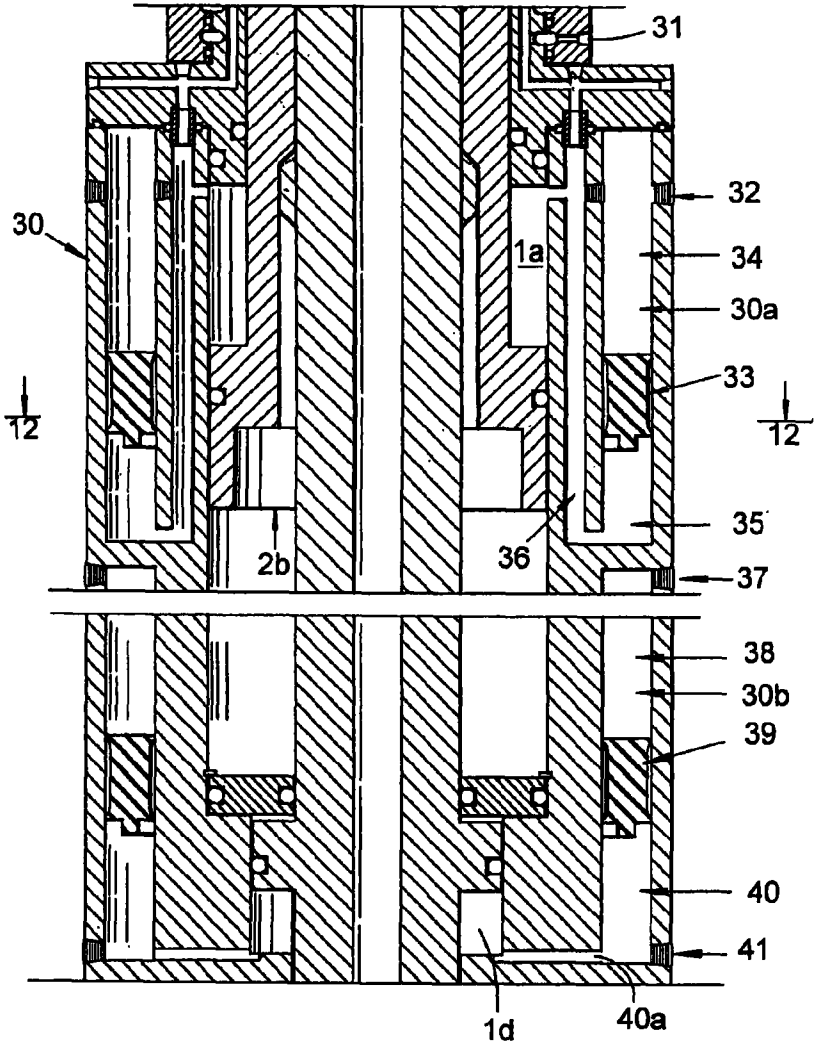
FIG. 11 is a side view, in cutaway, of a part of the apparatus, with options.

FIG. 11 is a side view, fragmented, of an alternate configuration of the apparatus of the invention. Essentially, it is FIG. 1 with accumulators added to the main body, and some fluid conducting galleries 36 enlarged. The housing, with peripheral accumulator chambers is now captioned 30. In the upper accumulator, annular piston 33 separates gas 34 and liquid 35. Liquid passes through port 31 and gas is charged through port 32. Ballast is provided by the upper accumulator to chamber 1*a*, and float is provided for the main body.

The lower accumulator, with piston 39 separating air, or gas, 38 from oil 40 provides ballast, by way of duct 40*a*, to chamber 1*d*, and float to the active arbor. Gas is charged through port 37 and liquid may be supplied or drained through port 41.

By designer preference, either accumulator, or both, may be omitted. Either accumulator, as shown, can be replaced by integral accumulators readily available in the market place.

Piston 3*a* can be biased upward, causing active arbor 3 to activate slips to engage pipe. To release the pipe, pressure is applied to chamber 1*c*, enough to overcome pressure in chamber 1*d*. If the apparatus is being taken from service and transported, pressure in chamber 1*d* will expand the slips. If pressure is removed from chamber 1*d*, spring 12 will pull the slips to their minimum diameter.

Vent 41 is available for removing pressure from chamber 1*d* if the apparatus is not rotating. If it is to be drained during apparatus rotation, a duct to swivel 5, in the nature of duct 36 can be arranged.

Figure 12:
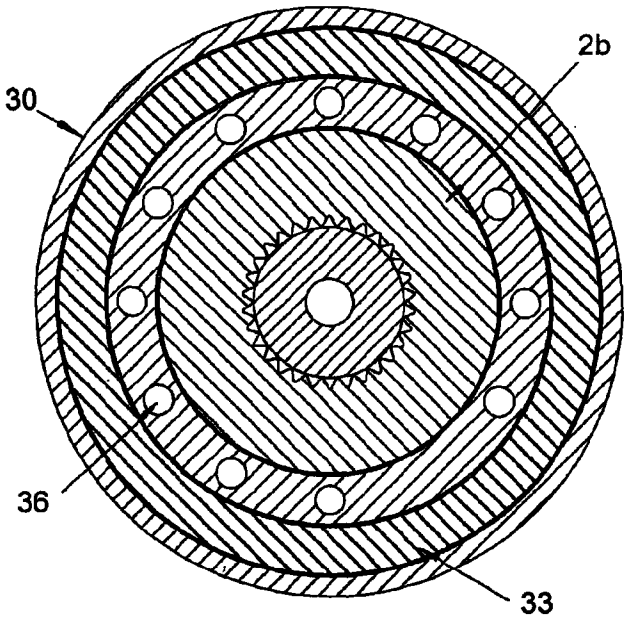
FIG. 12 is a sectional view taken along line 12-12.

FIG. 12 is a section taken along line 12-12 of FIG. 11. Note that piston 33 is a peripheral ring. The peripheral accumulator can be replaced by one or more integral accumulators opening to duct 40*a*.

Figure 14:
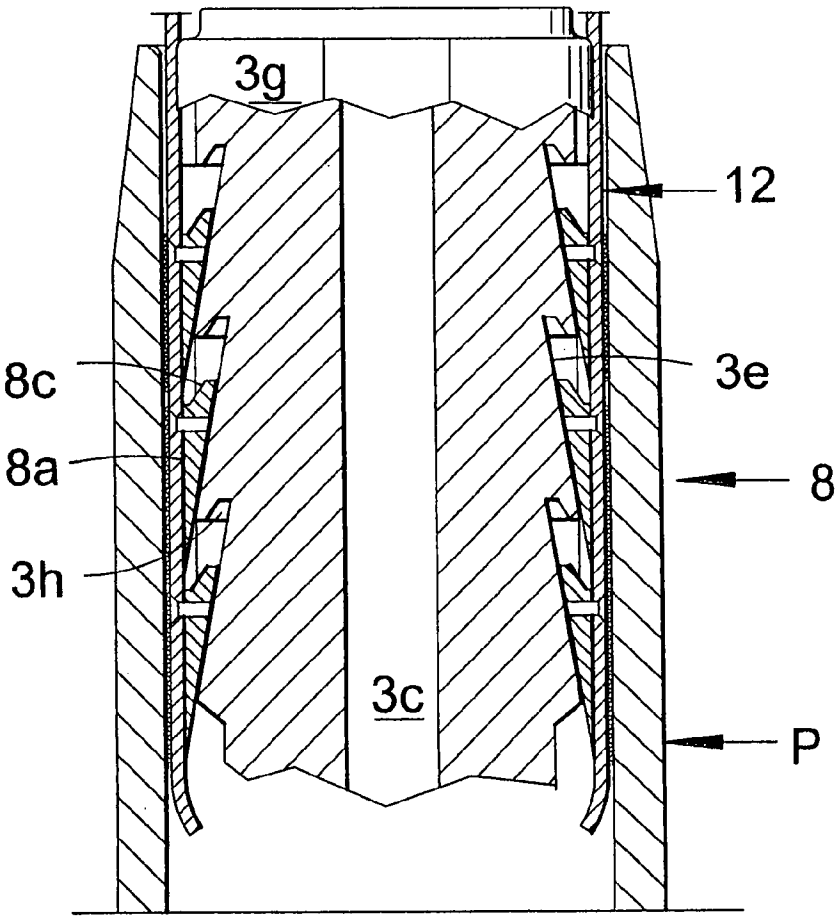
FIGS. 13-14, are fragmented side views, rather enlarged, of selected areas of FIGS. 2 and 4 respectively.
Figure 13:
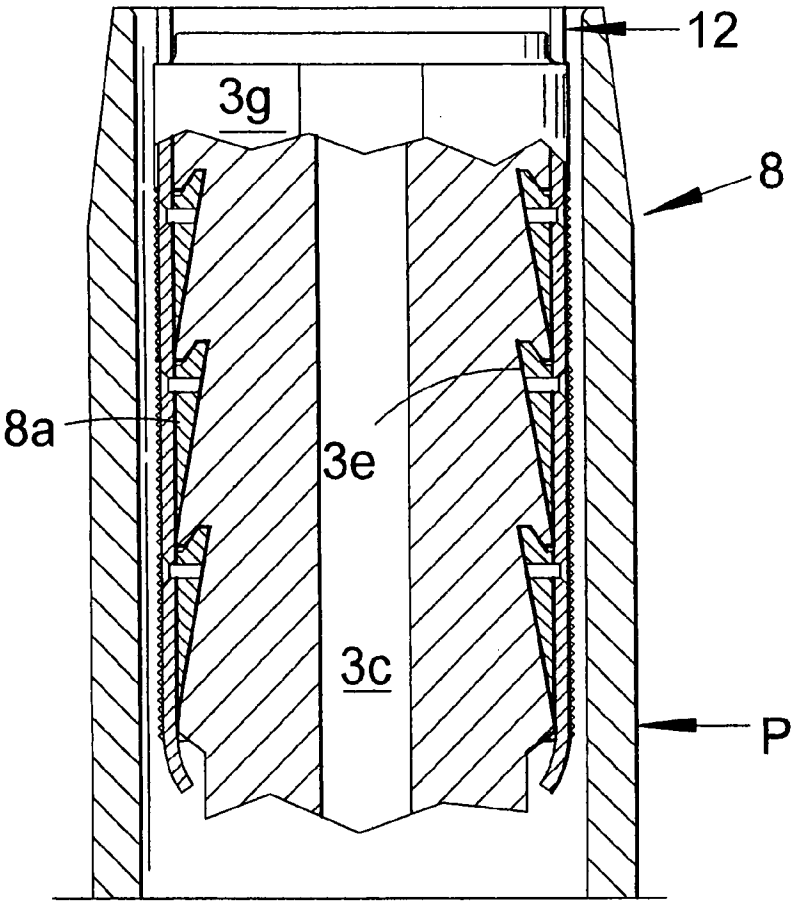

FIGS. 13-14 are fragmented side views, rather enlarged, of the gripper assembly 8 situated on the active arbor 3. FIG. 13 shows the retracted state of the grippers.

FIG. 14 shows the grippers deployed to engage the inner surface of pipe P. This scale admits the illustration of the optional capture features that secure the grippers to the active arbor for safer handling. Annular recess 3*h* in the active arbor receives the mating nose 8*c* of the grippers 8*a* when the grippers are not deployed as in FIG. 13.

Figure 16:
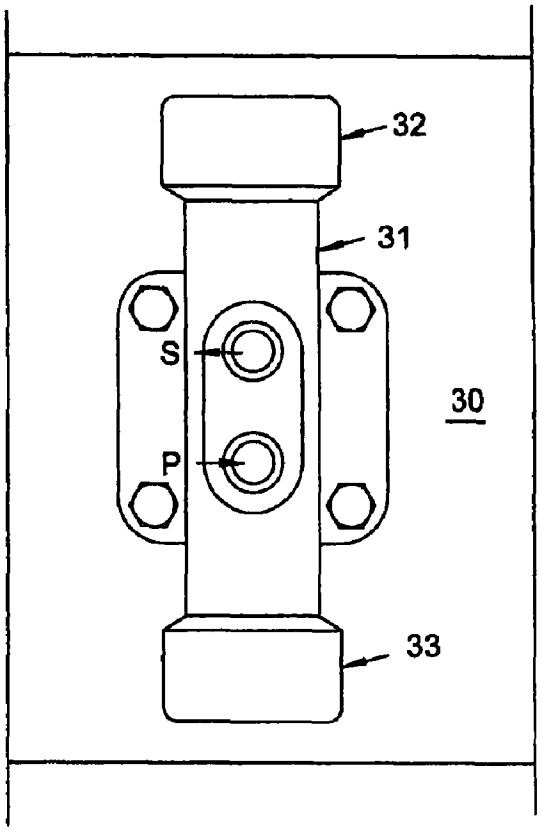
FIG. 16 is a side view of the apparatus shown by FIG. 15.
Figure 15:
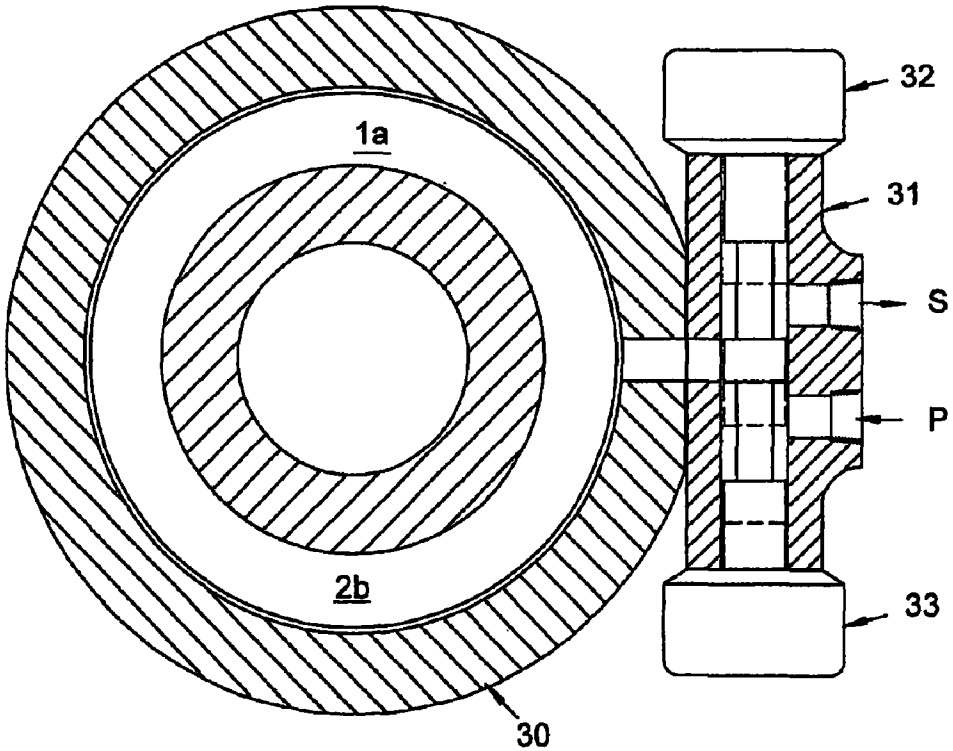
FIG. 15 is a section of an alternate form of the invention.

FIGS. 15 and 16 show a valve arrangement that allows the apparatus to be used to vertically vibrate a suspended pipe string.

Housing 30 is fitted with valve 31 that may be added to the apparatus shown by FIG. 1. Except for adding vibrating ability, it may not alter performance previously described herein. Activators 32 and 33 drive the valve 31 and may be driven by electric, pneumatic or hydraulic energy. The valve 31 alternates the flow of fluid through sump port s and pressure port p.

Figure 17:
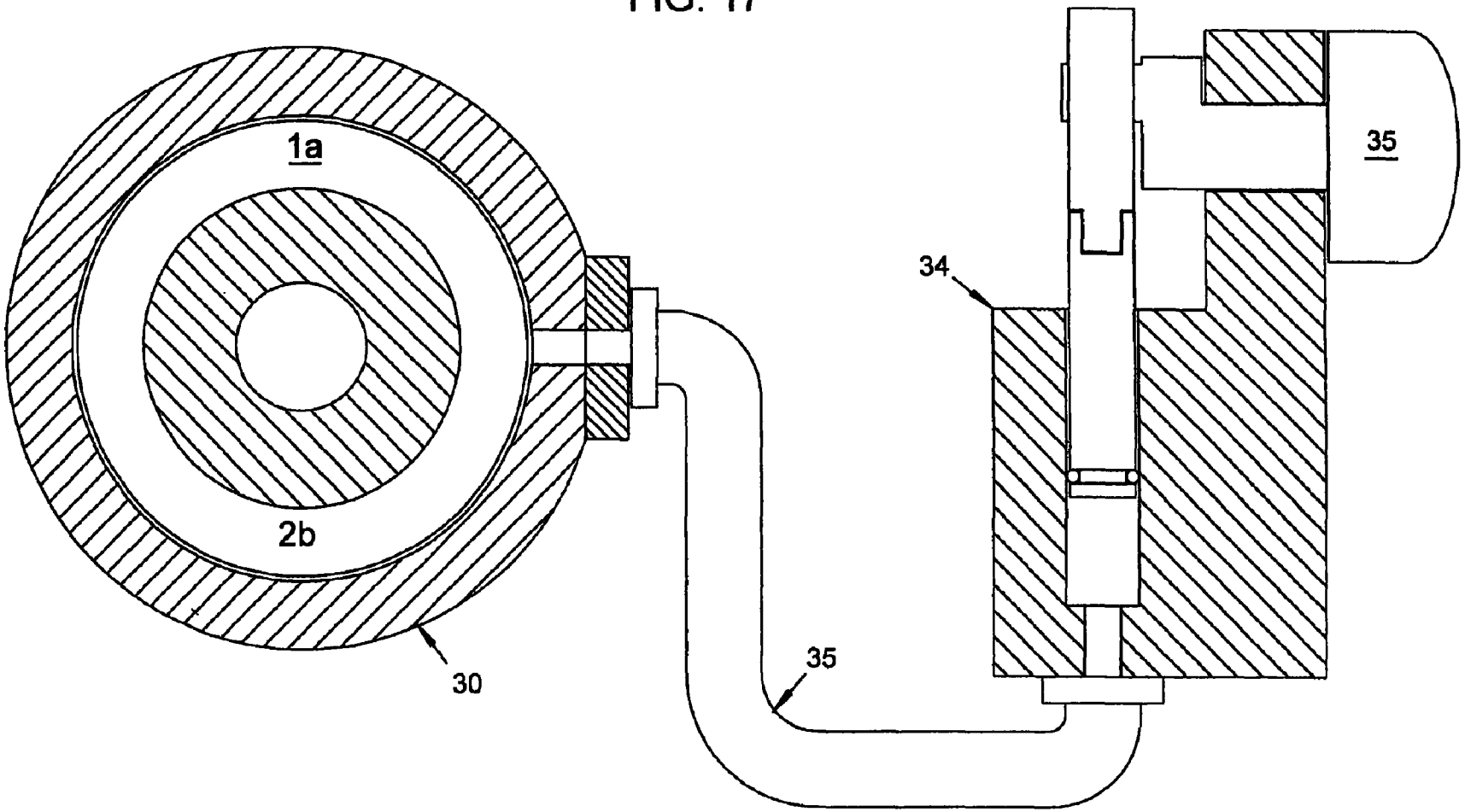
FIG. 17 is a symbolic sectional view of an alternate form of the invention.

FIG. 17 shows a symbolic arrangement that provides a valveless pump to provide a pulsating fluid flow to drive the apparatus as a vibrator to vertically activate a suspended pipe string. Drive 35 powers valveless pump 34 to provide a pulsating fluid flow through duct 35 to enter chamber 1*a* to move piston 2*b*. These features may be added to the housing of FIG. 1.

From the foregoing, it will be seen that this invention is one well adapted to attain all of the ends and objects hereinabove set forth, together with other advantages which are obvious and which are inherent to the apparatus.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, we claim:

1. A pipe handling apparatus for assembling and dismantling pipe strings used in wells, the apparatus comprising:

a) a main arbor arranged for attachment to an overhead support;

b) a main body situated on said main arbor for axial movement thereon, said mail arbor and main body defining an assembled length;

c) an active arbor supported by said main body, extending therefrom, arranged for axial movement relative thereto, and rotationally connected to said main arbor;

d) a first fluid powered hydraulic cylinder arranged to vary the assembled length of said main arbor and said main body in response to fluid power selectively supplied by a separate source;

e) a second fluid powered hydraulic cylinder arranged to adjust the assembled length of said main body and said active arbor in response to fluid power selectively supplied by a separate source;

f) a wedge-lock pipe gripper situated on said active arbor for gripping pipe by contact with said pipe's inner surface when said assembled length of said main body and said active arbor is selectively adjusted; and g) fluid conducting galleries, at least partly in said main body, arranged to conduct fluid to enable said separate source of fluid power to selectively actuate said first and said second fluid powered hydraulic cylinders.

2. The apparatus according to claim 1 wherein said fluid conducting galleries, at least in part, are in a swivel bearingly and sealingly mounted on said main body, to allow said main body to rotate relative thereto to enable a stationary said separate source of fluid power to selectively control said hydraulic cylinders.

3. The apparatus according to claim 1 wherein said attachment to an overhead support is accomplished by a tool joint on said main arbor.

4. The apparatus according to claim 1 wherein said main body is free to rotate relative to said main arbor.

5. The apparatus of claim 1, further comprising least one accumulator arranged to exchange fluid flow surges with galleries that supply fluid to move said first hydraulic cylinder.

6. The apparatus of claim 1, further comprising at least one accumulator arranged to exchange fluid flow surges with galleries that supply fluid to move said second hydraulic cylinder.

7. A pipe handling apparatus for assembling and dismantling pipe strings being installed in or removed from wells, the apparatus comprising:

a) a main arbor and a main body having a telescoping relationship, said main arbor extending from said main body and having a connector for attachment to an overhead support;

b) an active arbor telescopingly received in said main body, and extending some variable distance therefrom;

c) a first fluid powered hydraulic cylinder, responsive to fluid power manipulation at a separate location, to vary the extension of said main arbor from said main body;

d) a second fluid powered hydraulic cylinder, responsive to fluid power manipulation at a separate location, to vary the extension of said active arbor from said main body;

e) a pipe gripping arrangement on said active arbor for insertion into a pipe bore to grip or release pipe in response to change in the distance said active arbor extends from said main body;

f) a fluid conducting conduit situated to receive drilling fluid from said drilling rig, conduct it along said main and active arbors and to inject said drilling fluid into said pipe bore;

g) a fluid handling gallery arrangement, at least partly situated in said main body, to deliver said fluid power and control to said first and said second motors when said main arbor is rotating and said fluid power manipulation is provided from a stationary installation; and h) a telescoping relationship between said main arbor and said active arbor comprising mating non-circular surfaces to conduct torque between the two arbors.

8. A pipe handling apparatus according to claim 7 wherein said fluid handling gallery arrangement includes a swivel bearingly and sealedly situated on said main body.

9. A pipe handling apparatus according to claim 7 wherein said pipe gripping arrangement comprises pipe grippers that extend a variable radial distance from said active arbor and change said radial distance when said active arbor is moved relative to said body.

10. A pipe handling apparatus according to claim 7 wherein said non-circular surfaces are splines.

11. A pipe handling apparatus according to claim 7 wherein said main arbor is terminated at an upper end by a tool joint.

* * * * *